United States Patent [19]

Urbanski et al.

[11] Patent Number: 4,954,801

[45] Date of Patent: Sep. 4, 1990

[54] ELECTRIC COIL AND IN PARTICULAR ELECTROMAGNET ARRANGEMENT COMPRISING A COIL SPOOL AND A COIL CASING

[75] Inventors: Patrick Urbanski, Saint Just en Chaussee, France; Jo Smolders, Wespelaar, Belgium

[73] Assignee: Bristol Babcock S.A., Mouy, France

[21] Appl. No.: 448,317

[22] Filed: Dec. 11, 1989

[30] Foreign Application Priority Data

Dec. 12, 1988 [FR] France ..... 88 16328

[51] Int. Cl.[5] ..... H01R 27/04

[52] U.S. Cl. ..... 336/90; 335/278; 336/107; 336/192

[58] Field of Search ..... 335/278, 296, 299; 310/71; 336/105, 107, 192, 198, 208, 90

[56] References Cited

U.S. PATENT DOCUMENTS 2,963,678 12/1960 Wolf et al. ..... 336/192 X
3,359,520 12/1967 Foerster ..... 336/192

FOREIGN PATENT DOCUMENTS 3151943 7/1983 Fed. Rep. of Germany .
3310289 9/1984 Fed. Rep. of Germany .
2458135 12/1980 France .
2502836 10/1982 France .
2581234 10/1986 France .
2050066 5/1983 United Kingdom .
2112746 6/1985 United Kingdom .

*Primary Examiner*—Thomas J. Kozma
*Attorney, Agent, or Firm*—Kenyon & Kenyon

[57] ABSTRACT

An electric coil arrangement comprising a coil spool which includes at each end a flange, a coil casing and an outer connection device which comprises terminal connectors anchored within the flange and a connection socket including outer connection plugs, the connecting socket being mounted in fixed relationship on the outer surface of the coil casing at the flange for anchoring the pins whereas the socket and the outer connection pins are shaped so that the pins engage the socket when positioning the casing so as to form said connecting plugs.

5 Claims, 3 Drawing Sheets

ELECTRIC COIL AND IN PARTICULAR ELECTROMAGNET ARRANGEMENT COMPRISING A COIL SPOOL AND A COIL CASING

The present invention relates to an electrical coil and in particular electromagnet arrangement of the type comprising a coil spool which comprises a cylindrical coil-carrying body and at each end a flange, a sleeve-shaped coil casing enclosing said coil in coaxial relationship and a device for connection the arrangement which comprises terminal connectors anchored into one of said flanges and provided each one with a pin connected to the coil and with an outer connection pin and a connecting socket or receptacle comprising connecting plugs.

Electromagnets of this kind are already known. Their outer connection pins are connected to one end of conducting leads which are connected with the other end to said connecting socket or receptacle. The leads are held against motion at their connection with the terminal connectors on the outer surface of the coil advantageously by a suitable adhesive tape and extend out of the inner space of the electromagnet though a notch formed in the anchoring flange.

This connection of the terminal connectors to the socket through the agency of conducting leads which is additionally held against motion by means of an adhesive tape exhibits the inconvenience that the connecting device is not compact and that its making requires a relatively high number of operating steps.

The object of the present invention is to provide an arrangement of the type described hereinabove which does not suffer from the aforesaid inconveniences.

To reach this aim the connecting socket is mounted in stationary relationship on the outer surface of the coil casing at the flange for anchoring the pins and the socket and the outer connection pins are shaped so that the pins engage or extend into the socket when positioning the casing so as to form said connecting plugs.

According to an advantageous characterizing feature of the invention the outer connection pins are folded back so as to extend in parallel relation to the axis of the arrangement from the plane of their anchoring flange outside of the casing and the socket is made as a box or housing which comprises in its wall adjacent to said flange holes through which the folded back pins extend into the box.

The invention will be better understood and further objects, characterizing features, details and advantages thereof will appear more clearly as the following explanatory description proceeds with reference to the accompanying diagrammatic drawings given by way of non limiting example only illustrating a presently preferred specific embodiment of the invention and wherein.

Referring to the Figures the electrical coil arrangement according to the invention will be described hereinafter taking an electromagnet as an example.

Figure 1:
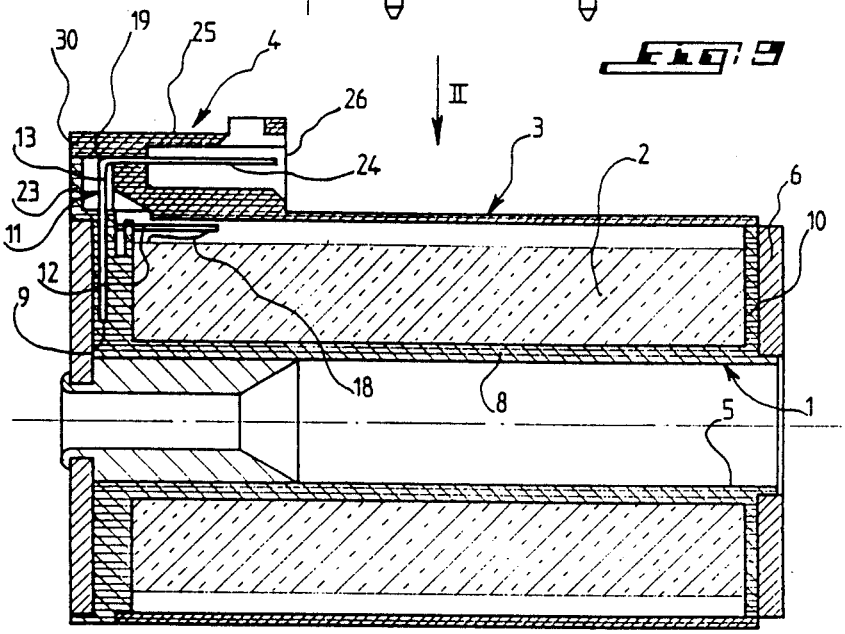
FIG. 1 is a view in axial section of an electromagnet according to the present invention.

As shown on FIG. 1 an electromagnet according to the invention comprises a coil spool 1 which carries the coil or winding 2, a coil casing S which surrounds the spool 1 in coaxial relationship therewith and a device 4 for connecting the coil 2 to outer connecting wire leads (not shown). The spool and the casing are made through moulding from plastics material. The reference numeral 5 designates the passageway for a plunger core (not shown) of the electromagnet. The reference numeral 6 designates elements of the yoke of the magnetic circuit of the electromagnet.

Figure 4:
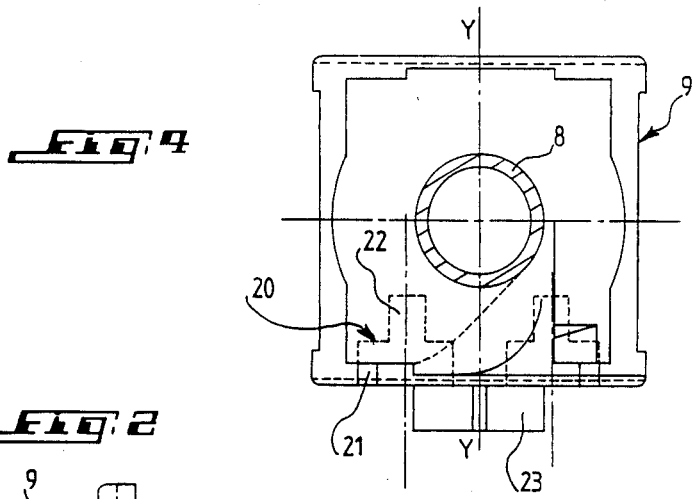
FIG. 4 is a sectional view taken upon the line IV—IV of FIG. 3.
Figure 2:
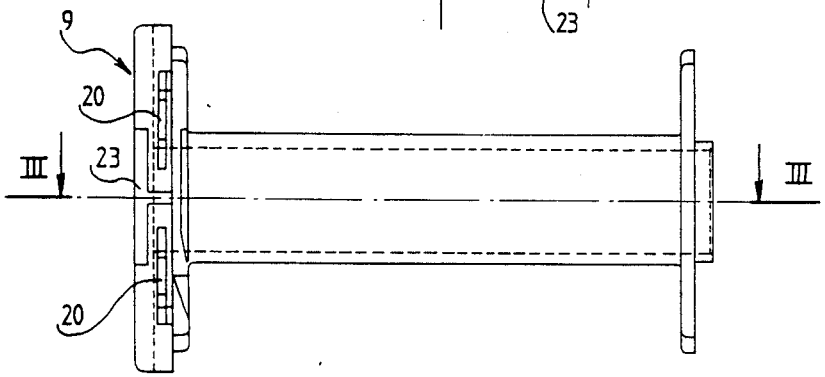
FIG. 2 is a view of the electromagnet spool according to the invention seen in the direction of the arrow II of FIG. 1.
Figure 3:
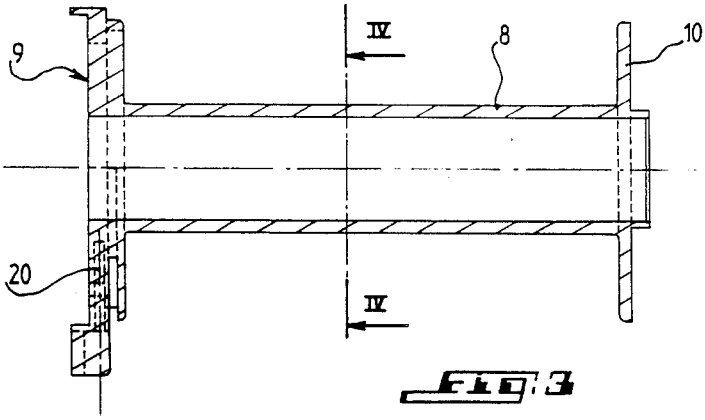
FIG. 3 is a sectional view taken upon the line III—III of FIG. 2.

FIGS. 2 to 4 show the structure of the coil spool 1. The latter comprises a cylindrical body 8 on which the coil 2 will be wound and which carries at its ends cheek-like flanges 9 and 10. The cheek or web 9 is designed to allow both terminal connectors, tags or lugs 11 which provide for the electrical connection of the coil 2 to the connecting device 4 to be inserted and anchored.

Figure 8:
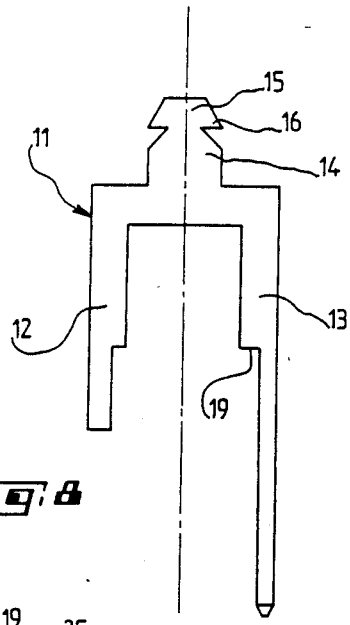
FIG. 8 is an elevational view of a connecting pin according to the present invention.
Figure 9:
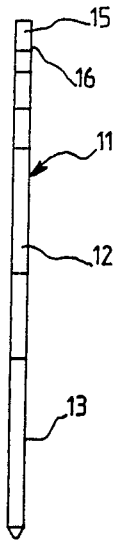
FIG. 9 is a side view of the pin shown on FIG. 8.

As shown on FIGS. 8 and 9 a tag or terminal connector 11 according to the invention is made as a generally U-shaped flat element the legs of which form the connecting pins 12 and 13 and which carries at its base an anchoring lug 14. The latter is of a generally rectangular shape and exhibits at its free end hook-shaped elements with sharp angles 16 located substantially at the substantial parallel side edges of the lug. These sharp edges provide for the anchoring of the terminal connectors as will be explained hereinafter. The connecting or contact pins 12 and 13 have differing lengths. The shorter pin 12 is connected to the coil 2 as diagrammatically shown at 18 whereas the terminal connector 13 has a relatively great length to allow same to form one of the contact plugs of the connecting device 4 as shown on FIG. 1. Those portions of the pins 12 and 13 which are inside of the cheek or web 9 of the spool have a greater width than their ends thereby providing a greater stiffness or rigidity to the terminal connectors. The pin 13 is folded back at the sudden change of width at 19. The contact terminal connectors are advantageously made from tinned brass.

To allow the terminal connectors 11 to be inserted the cheek or flange 9 is formed with two cavities 20 at the connecting device 4 which are symmetrical with respect to the axis Y—Y (FIG. 4). Each cavity has a shape substantially complementary of or mating with the base of one contact terminal connector 11 and comprises for that purpose an outer part the width of which corresponds to that of the base of one terminal connector and a narrower inner part of rectangular shape having a width corresponding to that of the anchoring lug 14 of the terminal connector so as to allow this lug to be inserted and to make a later withdrawal impossible or very difficult on account of the sharp angles 16 of the lug. The terminal connectors 11 are positioned so that the pins 13 are adjacent to the axis Y—Y. On that side of the cheek or web 9 into which open the cavities 20 and sidewise offset outwards with respect to it extends a raised protecting rib 23 the upper edge of which is at the level of the area 19 where the contact pin 13 is folded back at right angles to its portion of insertion into the cheek. The width of this rib is slightly greater than the spacing of the outer side edges from both terminal connectors 13 as shown on the FIG. 2.

Figure 5:
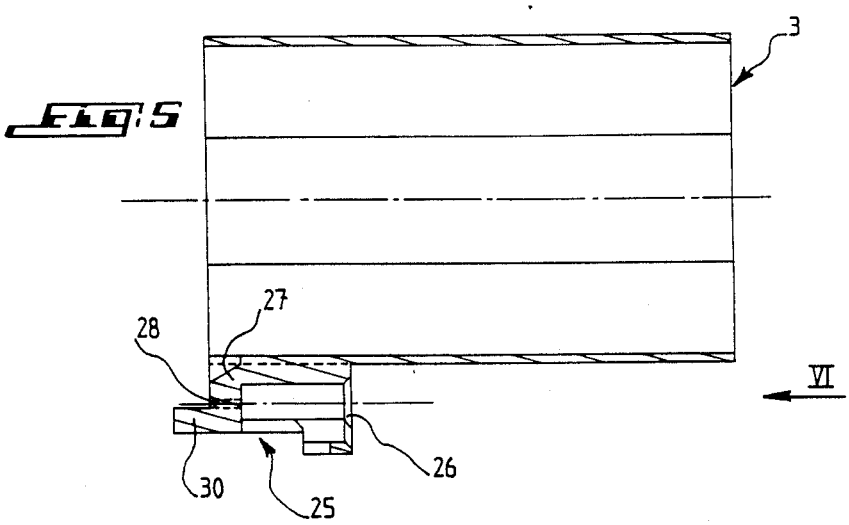
FIG. 5 is a view in axial section of the coil casing taken upon the line V—V of FIG. 6.
Figure 7:
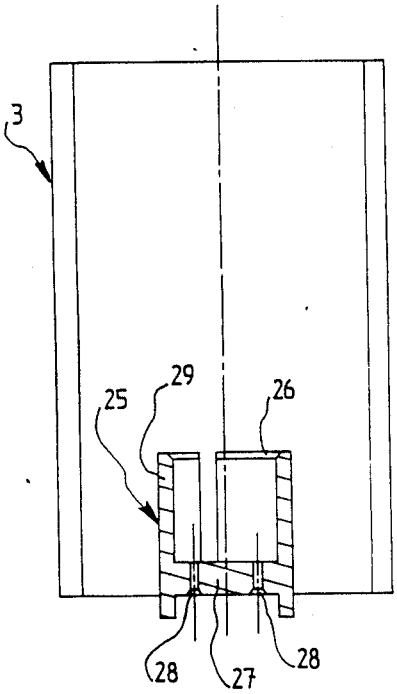
FIG. 7 is a sectional view taken upon the lines VII—VII of FIG. 6.
Figure 6:
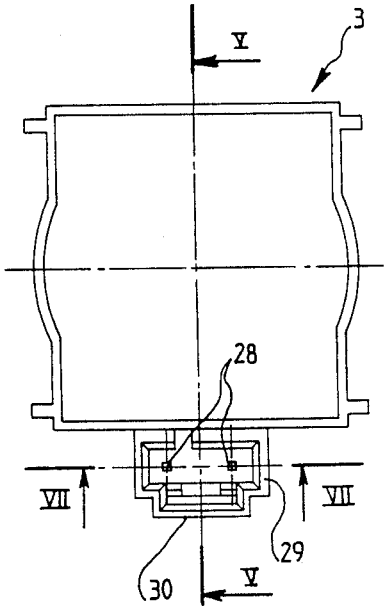
FIG. 6 is an axial view of the casing seen in the direction of the arrow VI of FIG. 5.

With reference to FIGS. 5 to 7, the coil casing 3 will be described hereinafter.

This casing consists of a sleeve the shape of which corresponds to that of the cheeks or webs 9 and 10 of the spool, i.e. it is of a substantially rectangular shape. This sleeve coaxially surrounds the spool 1 together with its coil 2 and carries on its outer surface at the terminal connectors 11 a structure 25 which forms the box of the connecting device 4 and which is of a generally parallelepipedic shape. This box or housing opens at 26 towards the centre of the sleeve. The opposite outer wall 27 comprises passageways 28 which extend in parallel relation to the centre line axis of the sleeve and allow the folded back parts 24 of the pins 13 of the terminal connectors 11 to pass therethrough as illustrated on FIG. 1. This Figure also shows that the wall 27 is arranged so as to leave uncovered the outlets of the cavities 20 for inserting the terminal connectors 11. The side walls 29 and the upper wall 30 of the box or housing 4 extend beyond the wall 27 and define a space 31 which when the casing or sleeve 3 is in its position covering the coil 2 houses or accommodates that portion of the terminal connectors which extend out of the spool and is closed outwards by the protecting rib 23 of the spool.

The assembly of the spool 1 with the casing 3 allows to provide an arrangement the connecting device of which is compact. The terminal connectors 11 indeed through their pin 12 provide for the electric connection with the coil 2 and through their longer pin 13 form the plugs for the connecting socket of the device 4. To the advantage of the compactness of the structure is added the other major advantage of the simplicity of the mounting of the whole. After the coil 2 has been formed and the terminal connectors 11 have been inserted it suffices to connect the coil to the pins 12 and to fold back the pins 13 of the terminal connectors in the manner shown and to slip the sleeve or casing 3 upon the spool. The folded back portions 24 of the terminal connectors would then extend through the passageways 28 of the wall 27 of the box towards the inside of the latter so as to make it possible to form the plugs of the connecting device. The passageways provide for the guiding and the holding of the plugs.

What is claimed is:

1. An electrical coil and in particular electromagnet arrangement of the type comprising a coil spool which includes a cylindrical coil-carrying body and at each end a flange, a sleeve-shaped coil casing enclosing said coil and a device for the outer electrical connection of the arrangement which comprises terminal connectors associated with one of said flanges and provided each one with a pin connected to the coil and with an outer connection pin, wherein the improvement consists in that the coil casing is coaxially positioned on the spool and is adapted to be positioned through axial fitting on the cylindrical body, in that the terminal connectors are anchored within the flange adjacent to the forward end of the casing by an anchoring lug portion extending into the flange from the periphery thereof, those portions which form the connecting pins are folded back so as to extend in parallel relation to the centre line axis of the arrangement from the plane of the anchoring flange in the direction of the other flange so that those portions which form the outer connection pin be located at a distance from the axis of the arrangement which is greater than that of the outer peripheral surface of the casing and in that the latter carries at its end adjacent to the anchoring flange a wall which extends at right angles to the axis of the arrangement and exhibits axial holes through which the outer folded back pins extend upon the fitting of the casing onto the cylindrical body.

2. An arrangement according to claim 1, wherein said wall is a part of a structure of a box forming an outer connecting socket of the arrangement.

3. An arrangement according to claim 2, wherein one terminal connector has a U-shape the legs of which form said connecting pins and which is provided at its base with an aforesaid anchoring lug and the anchoring flange comprises cavities for receiving said terminal connectors, which exhibit a shape corresponding to that of the terminal connectors and extend towards the inside of the flange from the circumferential surface thereof at the connecting socket.

4. An arrangement according to claim 3, wherein the anchoring lug exhibits hook-shaped anchoring elements formed with sharp angles adapted to co-operate with the walls of the cavities for receiving the terminal connectors.

5. An arrangement according to claim 3, characterized in that the legs of one terminal connector which form the connecting pins have differing lengths and wherein the longer pin forms the outer connection pin which is folded back to form a connecting plug of the connecting socket.

* * * * *